US005934107A

United States Patent [19]

Lee et al.

[11] Patent Number: 5,934,107

[45] Date of Patent: Aug. 10, 1999

[54] CLOTHES WASHING MACHINE HAVING AN IMPACT DAMPER

[75] Inventors: Min-Soo Lee; Hwan-Young Choi, both of Kyungki-Do, Rep. of Korea

[73] Assignee: Samsung Electronics Co., Ltd., Suwon-City, Rep. of Korea

[21] Appl. No.: 09/025,304

[22] Filed: Feb. 18, 1998

[30] Foreign Application Priority Data

Feb. 18, 1997 [KR] Rep. of Korea ..... 97-4859

[51] Int. Cl.[6] ..... D06F 35/00; B65D 81/113; B65D 85/68

[52] U.S. Cl. ..... 68/3 R; 68/23.3; 206/320

[58] Field of Search ..... 68/3 R, 23.3; 210/364; 206/320

[56] References Cited

U.S. PATENT DOCUMENTS

| | | | |
|---|---|---|---|
| 2,703,974 | 3/1955 | Clark | 68/23.3 |
| 2,879,655 | 3/1959 | McCormick | 68/23.3 |
| 3,132,098 | 5/1964 | Bochan | 68/23.3 X |
| 3,216,225 | 11/1965 | Gil | 68/23.3 |
| 3,268,082 | 8/1966 | Galin | 210/364 |
| 4,366,902 | 1/1983 | Fanson et al. | 206/320 |

FOREIGN PATENT DOCUMENTS

| | | | |
|---|---|---|---|
| 133194 | 11/1978 | Japan | 206/320 |
| 128159 | 4/1992 | Japan | 206/320 |

*Primary Examiner*—Philip R. Coe
*Attorney, Agent, or Firm*—Burns, Doane, Swecker & Mathis, L.L.P.

[57] ABSTRACT

A washing machine includes a water tub, a spin basket mounted inside the water tub, a pulsator mounted in the spin basket, a reversible motor mounted under the water tub for driving the pulsator and spin basket, and a damping device for damping external impacts applied to the motor. The damping device is mounted to an underside of the motor and is received in a recess formed in an upper end of a cushioning member disposed beneath the machine during shipment to stabilize the motor.

12 Claims, 6 Drawing Sheets

CLOTHES WASHING MACHINE HAVING AN IMPACT DAMPER

BACKGROUND OF THE INVENTION (1) Field of the Invention

The present invention relates to a clothes washing machine and, more particularly, to a washing machine which is structured to resist being damaged by external impacts, e.g., during shipment.

(2) Description of the Related Art

Generally, a clothes washing machine includes a main body defining an outer configuration thereof, a water tub installed within the body, and a spin basket and blade (agitator) mounted within the water (tub). A power system for driving the spin basket and blade is mounted under the tub.

The power system typically comprises a motor, a power transmission system, and a belt for connecting the motor to the power transmission system. This will be described hereinbelow with reference to FIG. 6.

As shown in the drawing, a conventional power system comprises a power transmission system 100 having a drive motor (not shown). The power transmission system 100 comprises a hollow dehydrating (spin-dry) shaft 101 and a laundering shaft 102 inserted into the hollow dehydrating shaft 101. The laundering shaft 102 is divided into upper and lower halves, with a planetary gear unit 103 being disposed therebetween. The planetary gear unit 103 changes a rotating speed of the power transmission system 100.

A brake band 104 and a brake lever 105 are disposed beside the dehydrating shaft 101 to brake the rotation of the dehydrating shaft 101, for suppressing an idle rotation of the spin basket 110. A one-way bearing 106, permitting the dehydrating shaft 101 to rotate in only one direction, is mounted on an outer circumference of the dehydrating shaft 101. In addition, a clutch spring 107 and a clutch lever 108 for transmitting/interrupting power from the motor to the dehydrating shaft 101 and the laundering shaft 102 are mounted under the one-way bearing 106. A pulley 109 on which a belt (not shown) is engaged is mounted on a lower end of the laundering shaft 102.

In this conventional power transmission system 100, torque of the motor is selectively transmitted to either a rotating blade 111 or to both the blade 111 and the spin basket 110 through the clutch spring 107, thereby performing the washing and dehydrating operations, respectively. To achieve this, it is necessary that the clutch spring 107 has a high degree of tensile strength to enable the transmission or interruption of torque from the motor to either the dehydrating shaft 101 or the laundering shaft 102, both of which are rotated at a high speed. However, the manufacturing process for such a spring having high tensile strength is complicated, and, as a result, manufacturing costs are increased.

In addition, the brake band 104 for preventing the spin basket 110 from idling rotationally during the washing operation is, when it brakes the spin basket 110 in one direction, subjected to high resistance against force generated when the spin basket 110 is acted on by a water current within the water tub. The above described one-way bearing 106 must be used as a result, making the structure complicated and increasing manufacturing costs. Finally, an unpleasant noise is generated during the braking operation of the brake band.

As described above, the conventional power system of a washing machine is complicated with regard to the arrangement of parts for performing the washing, dehydrating and braking operations, making it difficult to manufacture the same and increasing manufacturing costs. In addition, because of the large number of parts needed for this complicated arrangement, much space is required which, in turn, acts to increase the overall size of the washer.

To solve the above described problems, in recent years, a direct-coupled washing machine in which the power transmission system is directly connected to the motor has been developed. However, such a power system is susceptible to being damaged by external impacts applied to the machine, e.g., during shipment.

SUMMARY OF THE INVENTION

Therefore, it is an object of the present invention to provide a washing machine having a structure which can prevent the power system from being damaged by an external impact.

To achieve the above object, the present invention provides a washing machine comprising a water tub; a spin basket mounted inside the water tub; a pulsator mounted in the spin basket; a reversible motor mounted to an underside of the water reserving basket; a hollow dehydrating shaft having an upper end coupled to the spin basket and a lower end extending outside the water tub; and a laundering shaft extending within the hollow dehydrating shaft such that the laundering shaft extends out of upper and lower ends of the hollow dehydrating shaft. The laundering shaft has an upper end coupled to the pulsator and a lower end coupled to the motor. Damping means for damping external impacts applied to the motor is mounted to an underside of the motor.

Preferably, the damping means comprises a damping rod screw-coupled on a central portion of a rotor of the motor.

Preferably, the damping means further comprise an elastic damping member attached to the coupling portion of the damping rod. The damping member has a diameter larger than that of the coupling portion.

The invention also pertains to a combination of the washing machine with a cushioning element for shipping.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF A PREFERRED EMBODIMENT OF THE INVENTION

Reference will now be made in detail to a preferred embodiment of the invention, illustrated in the accompanying drawings. Wherever possible, the same reference numbers will be used throughout the drawings to refer to the same or like parts.

Figure 1:
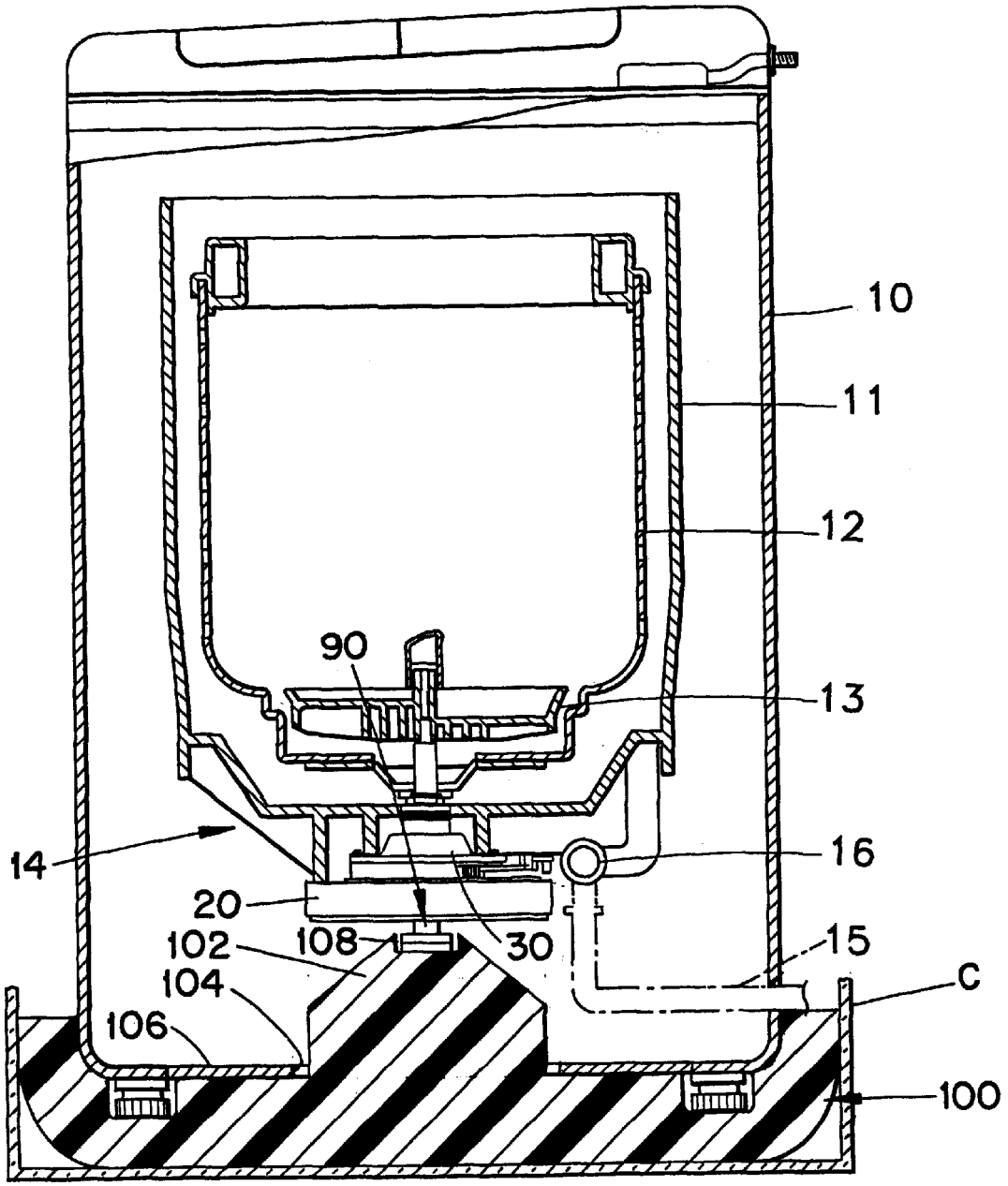
FIG. 1 is a vertical sectional view illustrating a washing machine and a cushioning element, according to the present invention is employed.

Referring first to FIG. 1, the inventive clothes washing machine of the present invention comprises a main body 10 defining an outer configuration thereof and a water tub 11 installed inside the main body 10 which holds water. A spin basket 12, inside of which laundry is washed, is provided inside the water tub 11. Installed above a bottom surface of the spin basket 12 is a pulsator 13 which oscillates in forward and reverse directions so as to generate water currents.

A power system 14, for driving the pulsator 13 and the spin basket 12, is installed on an underside of the water tub 11. The power system 14 comprises a reversible motor 20 and a power transmission system 30, which transmits rotating force of the reversible motor 20.

The power transmission system 30 is structured such that torque of the motor 20 can be transmitted to the pulsator 13 or, during dehydration (i.e., spin drying), to both the pulsator 13 and the spin basket 12.

In addition, a drain hose 15 is mounted on the right side (in the drawing) of the water tub 11, the drain hose 15 draining the water from the water tub 11 to the outside of the main body 10. A drain valve 16 for opening/closing the drain hose 15 is mounted on the drain hose 15. A drain motor (not shown), which controls the operation of the drain valve 16 and the power transmission system 30, is mounted between the drain valve 16 and the power transmission system 30.

Figure 2:
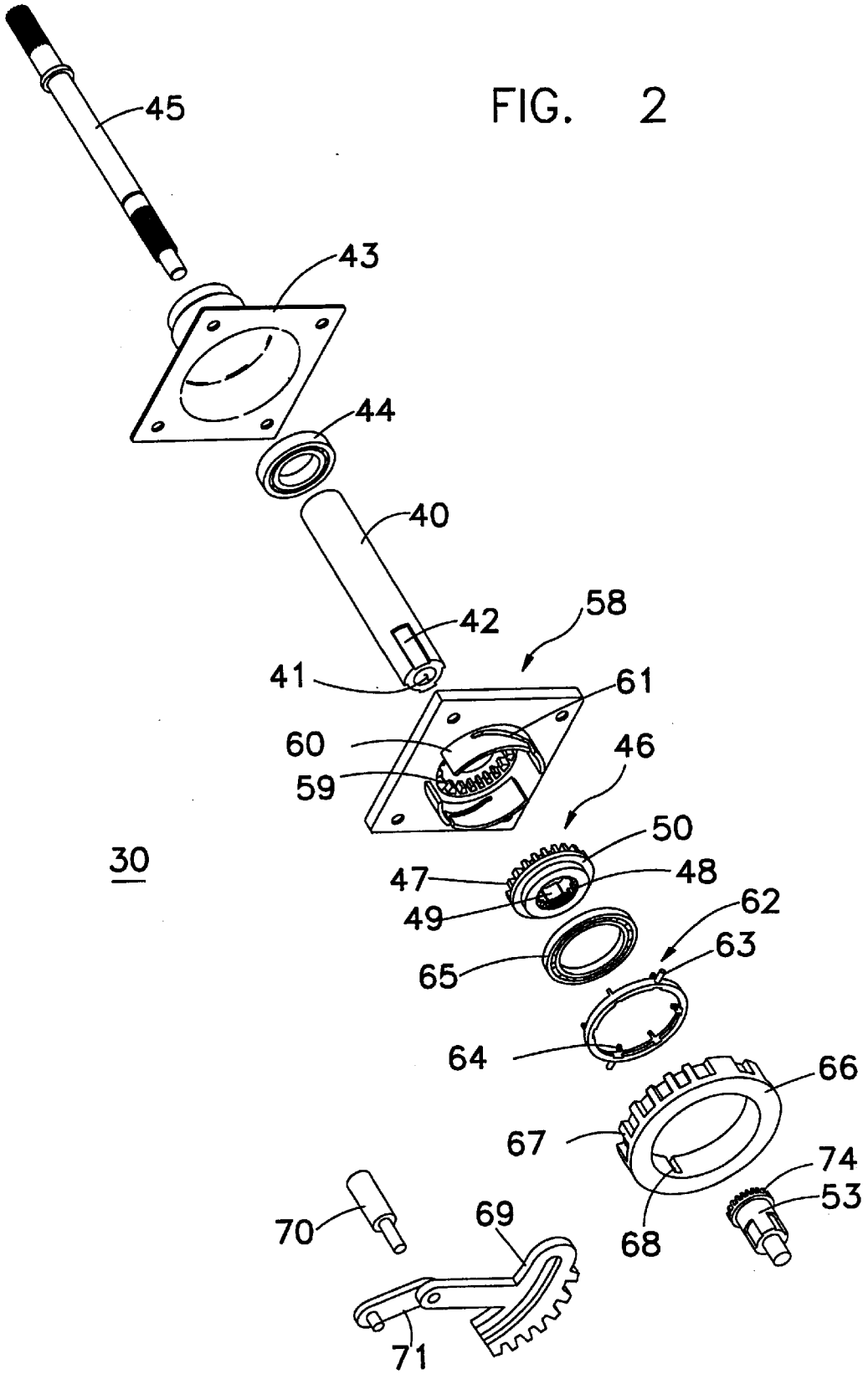
FIG. 2 is an exploded perspective view of a power system according to a preferred embodiment of the present invention.

The power transmission system 30 of the power system 14 will be described hereinafter more in detail with reference to FIGS. 2 and 3.

As shown in the drawings, the power transmission system 30 comprises a dehydrating shaft 40 and a coupling plate 43. The shaft 40 has a hollow section 41 and is coupled at its upper portion to the spin basket 12 after passing through a bottom surface of the water tub 11. The coupling plate 43 is mounted on an inner bottom surface of the water reserving basket 11, for supporting the dehydrating shaft 40. A bearing 44 is interposed between the coupling plate 43 and the dehydrating shaft 40 so as to provide relative rotation therebetween.

The power transmission system 30 further comprises a laundering shaft 45 extending through the dehydrating shaft 40, an upper end of which is coupled to the pulsator 13 and a lower end of which is coupled to a rotor 22 of the reversible motor 20.

A ring-shaped connecting gear 46 is slidably mounted on the dehydrating shaft 40 so as to selectively connect the dehydrating shaft 40 to the laundering shaft 45 for common rotation. When the connecting gear 46 is lowered, the dehydrating shaft 40 rotates together with the laundering shaft 45, and when the gear 46 is raised, only the laundering shaft 45 is rotated.

A coupling gear 53 which is designed to integrally rotate with the reversible motor 20 is mounted on a lower end of the laundering shaft 45. The coupling gear 53 is engaged with the connecting gear 46 when the connecting gear 46 is lowered.

The connecting gear 46 is provided with inner teeth 48 formed on an inner lower portion thereof and outer teeth 47 formed on an outer upper portion thereof. Guide projections 49 are formed on upper sides of the inner teeth 48. A plurality of guide grooves 42 are formed on a lower end of the dehydrating shaft 40, such that the guide projections 49 of the connecting gear 46 are slidably disposed in the guide grooves 42.

In addition, coupled on an outer bottom surface of the water tub 11 is a fixing plate 58. The fixing plate 58 is provided with inner teeth 59 meshing with the outer teeth 47 of the connecting gear 46 when the connecting gear 46 is raised, thereby suppressing rotation of the dehydrating shaft 40.

To allow the connecting gear 46 to elevate along the guide grooves 42 of the dehydrating shaft 40, there is provided elevating guide means comprising an elevating guide member 60 screwed to the fixing plate 58. The elevating guide member 60 is composed of two halves. Each of the halves is provided with an inclined elevating guide slit 61 having an opened lower end.

The elevating guide means further comprises an elevating ring 62 having elevating projections 63 which are received in respective ones of the guide slits 61. The elevating ring 62 is engaged with a stepped portion 50 of the connecting gear 46, interposing a bearing 65 therebetween. The bearing 65 is fixedly disposed on the projections 63 formed on an upper end of the elevating ring 62. The bearing 65 transmission of rotary force from the elevating ring 62 to the connecting gear 46 and vice versa.

Coupled on the elevating projections 63 is an elevating gear 66 which enables the elevating projections 63 of the elevating ring 62 to elevate along the elevating guide slits 61, thereby guiding the elevating operation of the connecting gear 46.

The elevating gear 66 is provided with teeth 67 formed on an outer circumference thereof and a pair of grooves 68 formed corresponding to the elevating projections 63.

A rotating gear 69 for rotating the elevating gear 66 is engaged with the teeth 67 of the elevating gear 66. Connected to the rotating gear 69 by a connecting pin 70 is a connecting bar 71 to which a driving force from the drain motor (not shown) is transmitted.

Figure 3:
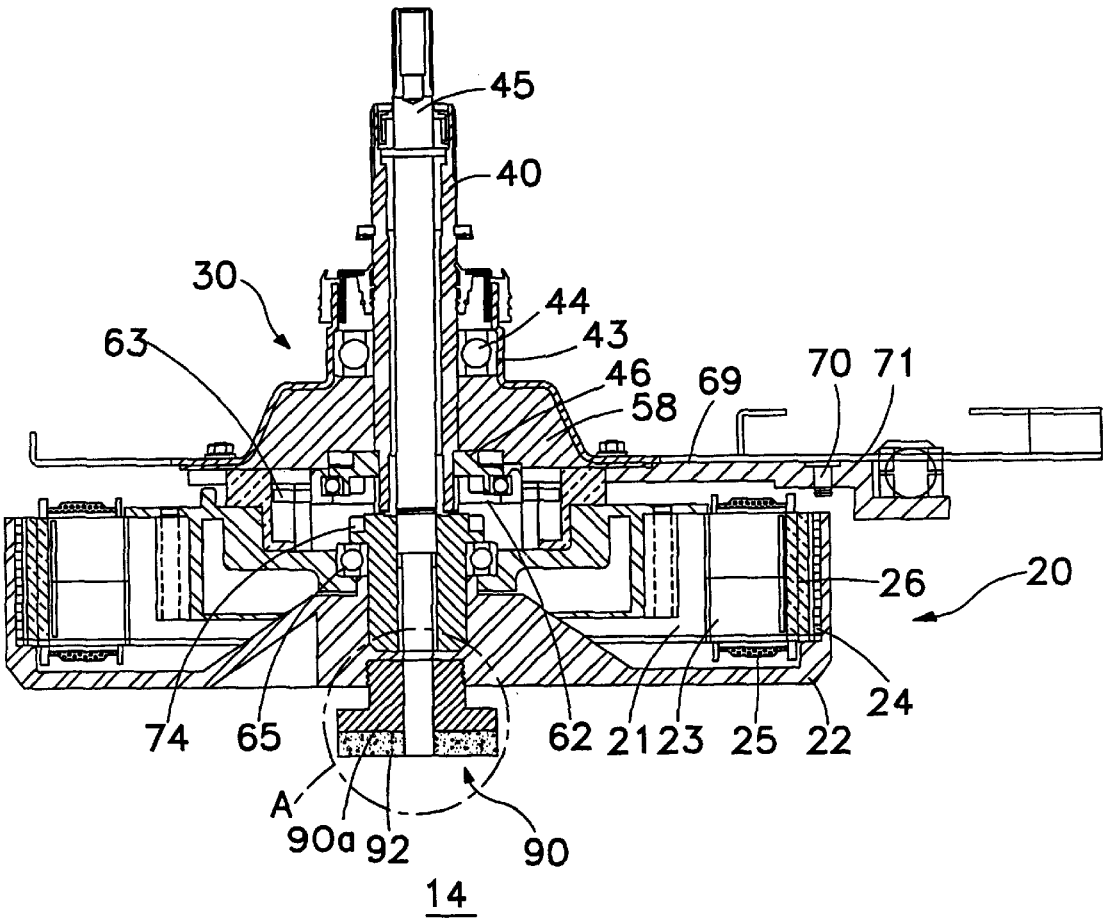
FIG. 3 is a sectional view showing a power system according to a preferred embodiment of the present invention.

The reversible motor 20 is a brushless direct current motor having a rotor 22, and a stator 21 disposed inside the rotor 22 as shown in FIG. 3.

The coupling gear 53, engaged with the laundering shaft 45 of the power transmission system 30, is coupled on a central portion of the rotor 22. The rotor 22 comprises a housing inside on which a rotor core 24 is coupled. Permanent magnets 26 are mounted along an inner circumference of the rotor core 24. The stator 21 is comprised of a stator core 23 facing the magnets 26. A coil 25 is wound around the core 23.

There is provided a damping device at an underside of the power system to prevent the power system from being damaged from external impacts and/or when the machine is tilted while being transported.

Figure 4:
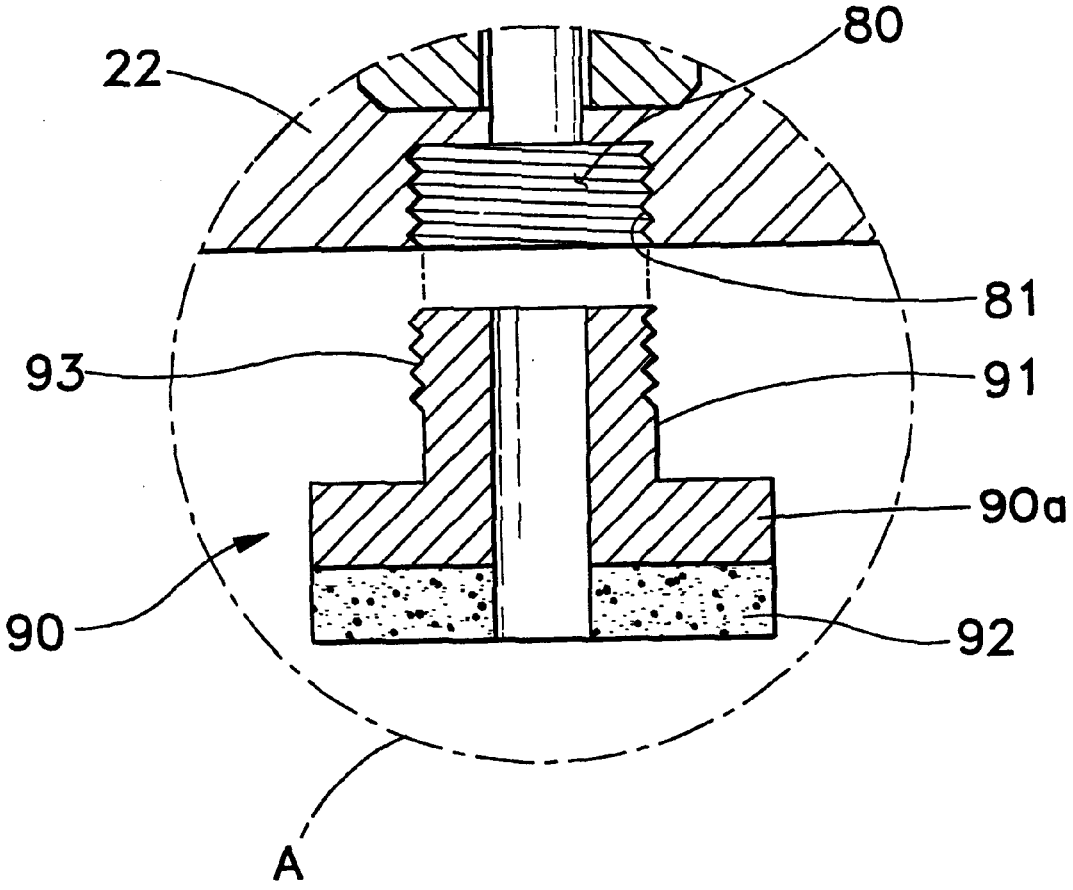
FIG. 4 is an enlarged view illustrating a circled portion of FIG. 3.
Figure 5:
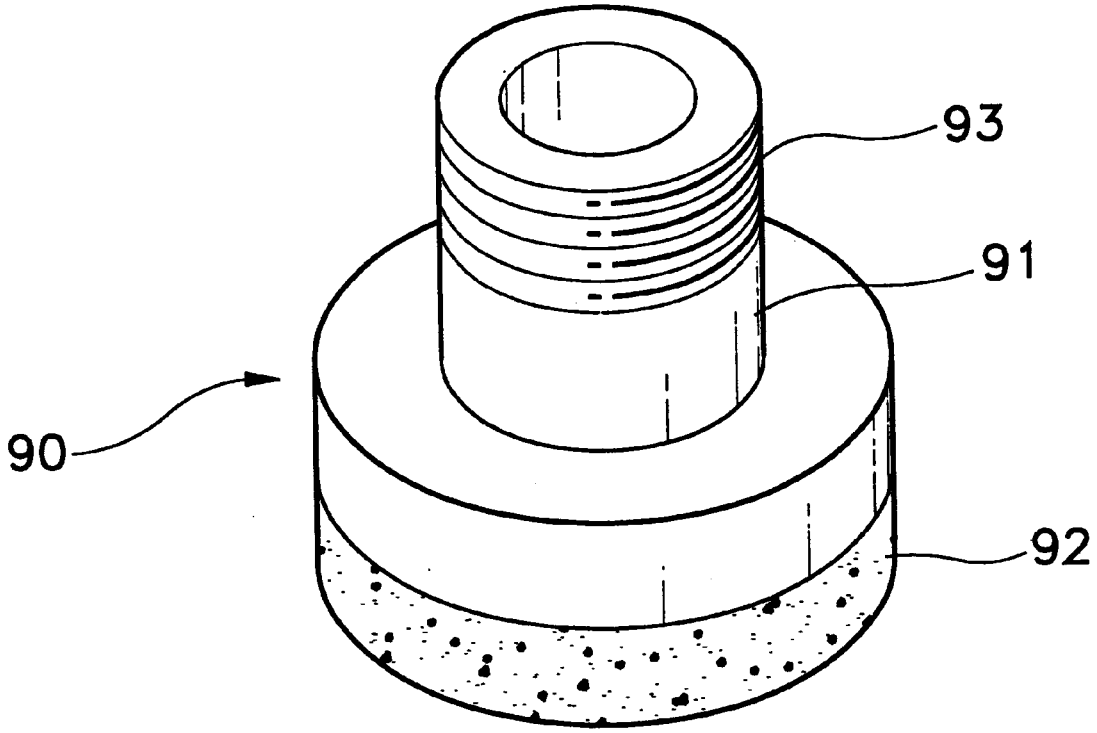
FIG. 5 is a perspective view illustrating a damping member according to a preferred embodiment of the present invention.
Figure 6:
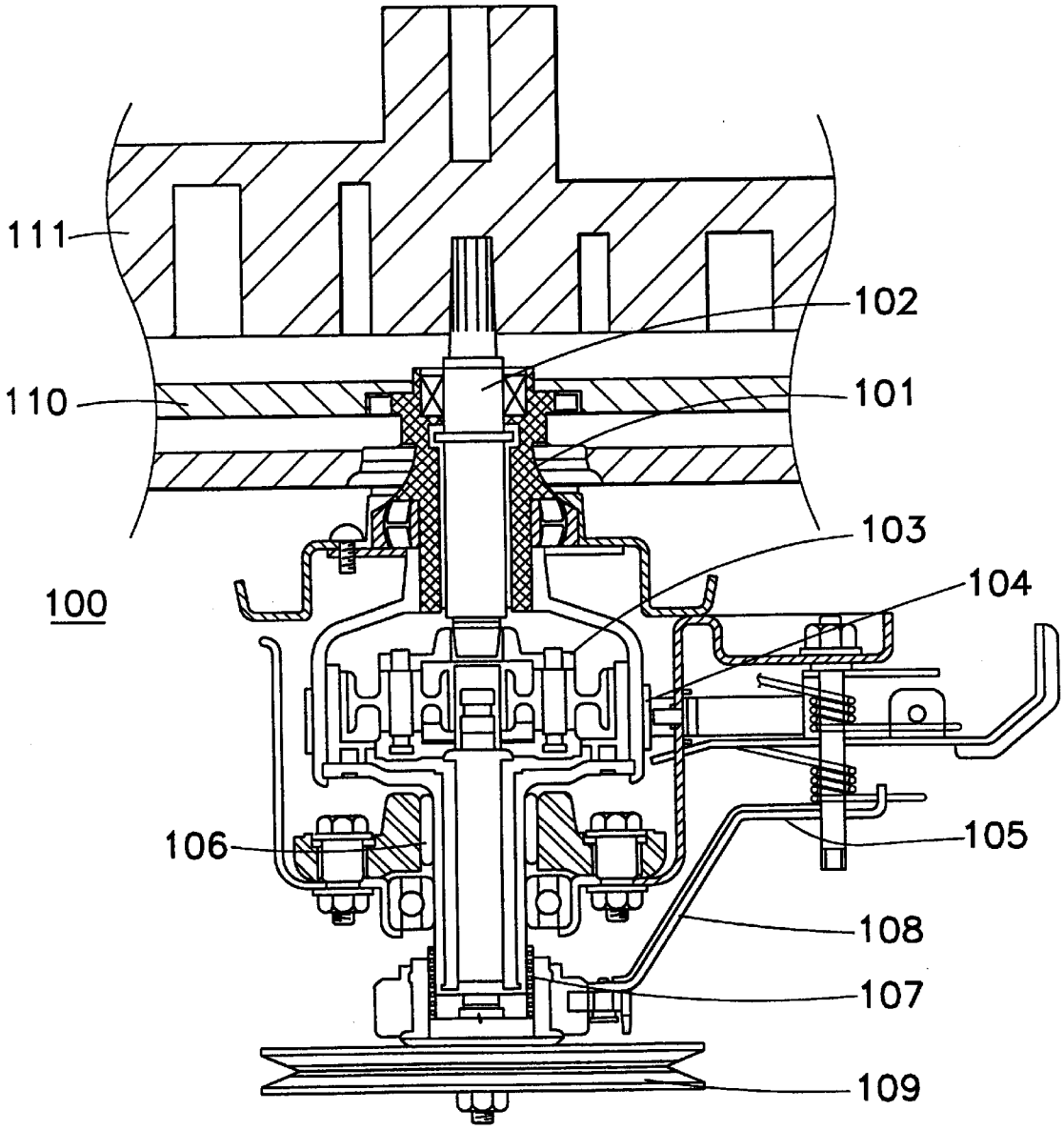
FIG. 6 (PRIOR ART)
FIG. 6 is a vertical sectional view showing a conventional power system.

As shown in FIGS. 4 and 5, the damping device comprises a damping rod 90 screw-coupled in a coupling hole 80 formed in a central portion of a bottom surface of the rotor 22.

That is, the damping rod 90 is provided at its coupling portion 91 with a male thread 93, while the coupling hole 80 of the rotor 22 is provided with a female thread 81 meshing with the male thread 93. The damping device further comprises a damping member 92 which is attached on a lower surface an enlarged head 90*a* of the damping rod 90 and is made of an elastic material. The damping member 92 has a diameter larger than that of the coupling portion 91 to provide a larger damping range.

During shipping, the clothes washing machine is disposed in a container C (shown partially in FIG. 1), and soft cushioning elements (e.g., Styrofoam pieces) are inserted between the machine and the shipping container. The cushioning elements include a bottom element 100 (see FIG. 1), a center pedestal portion 102 of which extends upwardly through a center hole 104 formed in a bottom 106 of the machine body 10. An upper end of the pedestal portion 102 includes an upwardly open recess 108 in which the damping rod 90 is disposed, in order to stabilize the power system 14 and keep it from shifting if the container is tilted, and to absorb external impacts.

The operation of the above described power system 14 of the washing machine according to the present invention will be described hereinafter.

Describing first a washing operation, when electric power is applied to the washing machine, the rotating gear 69 is rotated by the drain motor (not shown) which is driven by initial input current. By the rotation of the rotating gear 69, the elevating gear 66 rotates, rotating the elevating ring 62 engaged with the elevating gear 66. Accordingly, the elevating projections 63 ascend along the elevating guide slits 61 of the elevating guide member 60 such that the elevating ring 62 ascends. As a result, the connecting gear 46 ascends along the guide grooves 42 of the dehydrating shaft 40 without rotating (due to the presence of the bearing 51) so that the outer teeth 47 of the connecting gear 46 mesh with the inner teeth 59 of the fixing plate 58. Hence, the dehydrating shaft 40 cannot rotate.

In the above state, after laundry is placed in the spin basket 12, and water is fed to the water tub 11, and electric current is applied to the motor 20, the rotor 22 of the motor 20 rotates in the forward and reverse directions. Here, the laundering shaft 45 and the coupling gear 53 are rotated by the motor 20, thereby oscillating the pulsator 13 coupled to the laundering shaft 45 and performing the washing/rinsing operation.

When the washing/rinsing operation is finished, the water within the water tub 11 is drained by the opening of the drain valve 16 according to the operation of the drain motor (not shown).

After the water is completely drained, the dehydrating operation is performed in a state where the drain valve 16 is opened. The operation of the power system 14 during the dehydrating stage will be described hereinafter with reference to FIGS. 2, 3 and 5*b*.

When the drain valve 16 is being opened by the drain motor (not shown) the power transmission system 30 changes to a dehydrating driving state. That is, when the drain motor is operated, the drain valve 16 is opened, and at the same time, the rotating gear 69 rotates the elevating gear 66. By the rotation of the elevating gear 66, the elevating projections 63 descend along the elevating guide slits 61 of the elevating guide member 60, thereby lowering the elevating ring 62.

As a result, the connecting gear 46 descends along the guide grooves 42 of the dehydrating shaft 40, and the inner teeth 48 of the descended connecting gear 46 mesh with outer teeth 74 of the coupling gear 53.

In this state, when power is applied to the reversible motor 20 so as to rotate the rotor 22 at a high speed, the laundering shaft 45 and the connecting gear 46 engaged with the coupling gear 53 also rotate at a high speed, thereby rotating the dehydrating shaft 40 at a high speed.

By this operation, the pulsator 13 and the spin basket 12 rotate at a high speed such that the water retained in the laundry is forced out by the centrifugal force and drained through the drain hose 15.

When the motor 20 stops, electrical power is applied to the motor such that a reversed magnetic flux can be generated in the coil 24 and, thus, reversed electromagnetic force can be generated in the rotor 22. Therefore, the motor 20 generates a reverse rotational force such that the rotating speed of the rotor 22 is rapidly reduced and consequently stopped. The operation is controlled by a control portion of the washing machine.

In the above described washing machine, when the washing machine is tilted while being transported, the power system is rigidly maintained in a fixed position, because the damping rod 90 extends within the recess 108 of the cushioning element 100. That is, the cushioning element is provided to fix the damping rod 90. Since the power system 14 is fixedly supported to the damping rod 90, the power system 14 is maintained in a fixed position when the container is tilted or an external impact is applied thereto. Only a minimal amount of outer force can be transmitted to the power system because the damping member 92 acts to absorb the outer impact.

Furthermore, it is very easy to install the damping rod 90 into the washing machine since the structure of the damping rod is simple.

While the invention has been described in connection with what is presently considered to be most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. A clothes washing machine, comprising:

a water tub;

a spin basket mounted inside the water tub;

a pulsator mounted in the spin basket;

a reversible motor mounted to an underside of the water tub;

a hollow dehydrating shaft having an upper end coupled to the spin basket and a lower end extending outside of the water tub;

a laundering shaft extending within the dehydrating shaft such that the laundering shaft extends out of upper and lower ends of the dehydrating shaft, the laundering shaft having an upper end coupled to the pulsator and a lower end coupled to the motor; and damping means, for damping external impacts applied to the motor, mounted to an underside of the motor, the damping means comprising a damping rod screwed to the underside of the motor.

2. The washing machine of claim 1, wherein the damping rod comprises a coupling portion having a male screw thread.

3. The washing machine of claim 2, wherein the damping means further comprise an elastic damping member attached to a bottom surface of the damping rod.

4. The washing machine of claim 2, wherein the damping member has a diameter larger than that of the coupling portion.

5. The washing machine of claim 1 wherein the damping means includes an elastic damping member.

6. The washing machine of claim 5 wherein the damping means further includes a coupling member attached to the underside of the motor, the damping member being attached to a bottom surface of the coupling member.

7. A clothes washing machine in combination with a cushioning element for shipping, comprising:

a body having a floor;

a water tub disposed in the body;

a spin basket mounted inside the water tub;

a pulsator mounted in the spin basket;

a reversible motor mounted to an underside of the water tub;

a hollow dehydrating shaft having an upper end coupled to the spin basket and a lower end extending outside of the water tub;

a laundering shaft extending within the dehydrating shaft such that the laundering shaft extends out of upper and lower ends of the dehydrating shaft, the laundering shaft having an upper end coupled to the pulsator and a lower end coupled to the motor;

a damping rod projecting downwardly from an underside of the motor; and a cushioning element disposed beneath the floor of the body and including a center pedestal portion extending upwardly through a hole formed in the floor, an upper end of the cushioning element including an upwardly open recess into which the damping rod projects for stabilizing the motor during shipping and handling.

8. The combination according to claim 7 wherein the damping rod comprises a coupling portion having a male screw thread screwed to the underside of the motor.

9. The combination according to claim 8 wherein the damping means further comprise an elastic damping member attached to a bottom surface of the damping rod.

10. The combination according to claim 8 wherein the damping member has a diameter larger than that of the coupling portion.

11. The combination according to claim 7 wherein the damping means includes an elastic damping member.

12. The combination according to claim 11 wherein the damping means further includes a coupling member attached to the underside of the motor, the damping member being attached to a bottom surface of the coupling member.

* * * * *